United States Patent [19]

Perkins

[11] Patent Number: 4,589,491

[45] **Date of Patent: * May 20, 1986**

[54] COLD FLUID ENHANCEMENT OF HYDRAULIC FRACTURE WELL LINKAGE

[75] Inventor: Thomas P. Perkins, Dallas, Tex.

[73] Assignee: Atlantic Richfield Company, Los Angeles, Calif.

[ * ] Notice: The portion of the term of this patent subsequent to Oct. 16, 2001 has been disclaimed.

[21] Appl. No.: 749,137

[22] Filed: Jun. 27, 1985

Related U.S. Application Data

[63] Continuation of Ser. No. 643,764, Aug. 24, 1984, abandoned, which is a continuation of Ser. No. 425,342, Sep. 28, 1982, abandoned.

[51] Int. Cl.[4] ..... E21B 43/26

[52] U.S. Cl. ..... 166/302; 166/308

[58] Field of Search ..... 166/259, 271, 281, 285, 166/302, 305 R, 308

[56] References Cited

U.S. PATENT DOCUMENTS

| | | | |
|---|---|---|---|
| 3,003,557 | 10/1961 | Huitt et al. | 166/271 |
| 3,195,634 | 7/1965 | Hill | 166/302 |
| 3,223,158 | 12/1965 | Baker | 166/259 |
| 3,470,954 | 10/1969 | Hartley | 166/302 |
| 3,989,108 | 11/1976 | Allen | 166/302 |
| 4,068,720 | 1/1978 | Hessert et al. | 166/282 |
| 4,133,383 | 1/1979 | Ely | 166/285 |
| 4,321,968 | 3/1982 | Clear | 166/275 |
| 4,476,932 | 10/1984 | Emery | 166/302 |

*Primary Examiner*—Stephen J. Novosad
*Assistant Examiner*—Bruce M. Kisliuk
*Attorney, Agent, or Firm*—Albert C. Metrailer

[57] ABSTRACT

A method for forming a communication link between two boreholes including first cooling of a zone between the boreholes by pumping a cooling fluid down one borehole and producing it from the other and, after sufficient formation cooling has occurred, raising of the injection pressure at one borehole to initiate a fracture which tends to follow the cooled zone to the second borehole.

1 Claim, 2 Drawing Figures

COLD FLUID ENHANCEMENT OF HYDRAULIC FRACTURE WELL LINKAGE

This application is a continuation of application Ser. No. 643,764, filed Aug. 24, 1984, now abandoned, which is a continuation of application Ser. No. 425,342, filed Sept. 28, 1982, now abandoned.

BACKGROUND OF THE INVENTION

The present invention relates to the use of hydraulic fracturing to provide subterranean well linkage and more particularly, to the enhancement of such fracturing by use of cold injected fluids.

In certain circumstances, it is desirable to provide subterranean communication between boreholes in the earth. For example, in the case of a well blowout, an offset well is often provided for injection of drilling mud or other kill fluids into the blowout well. Ideally, the offset well is directionally drilled to actually intersect the blowout well. In practice, such direct intersection is rare. Communication between the offset injection well and the blowout well is often provided by use of hydraulic fracturing. However, in many cases, the fractures generated in the injection well do not intersect the blowout well. The fractures tend to propagate along naturally occuring areas of low stress which may or may not intersect the blowout well.

There are also a number of other circumstances in which subterranean links between boreholes are necessary. These include in-situ shale retorting, underground coal gasification and enhanced oil recovery fireflood processes. In each such case, a hydraulically induced fracture can, under the proper circumstances, provide the required link. However, as described above, the direction in which a fracture will travel is usually not controllable and often not even predictable.

SUMMARY OF THE INVENTION

Accordingly, an object of the present invention is to provide an improved method for the subterranean linking of boreholes by hydraulically induced fractures.

Another object of the present invention is to provide a method for controlling the direction of propagation of hydraulically generated fractures between wellbores.

Yet another object of the present invention is to provide a method for enhancing the formation of hydraulically induced fractures between a pair of wellbores.

According to the present invention, a cooling fluid is pumped down a first borehole and through a subterranean formation to a second borehole from which it may be produced. After the formation between the two boreholes has been cooled, a fracturing fluid is injected in the first borehole at a sufficient pressure to generate a hydraulic fracture between the two boreholes which fracture tends to be confined to the cooled portion of the formation between the two boreholes and is therefore directionally controlled.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
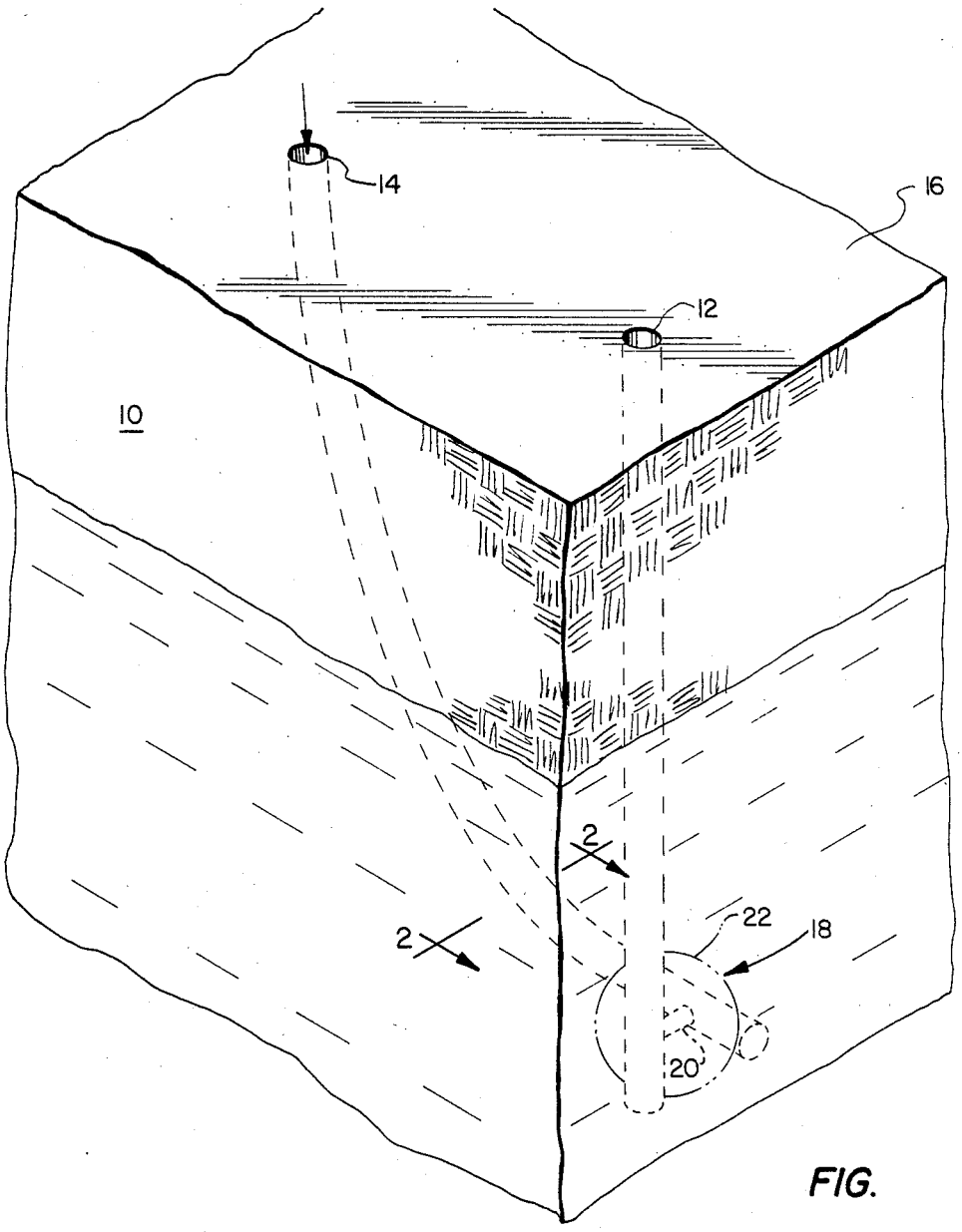
FIG. 1 is a sectional view of the earth containing two boreholes with reference to which practice of present invention will be described.

With reference now to FIG. 1, there is provided a cross-sectional illustration of a portion of the earth 10. A pair of boreholes 12 and 14 are illustrated extending from the surface 16 to various subterranean formations. Borehole 12, for example, may have been drilled to some oil producing formation below the illustrated section 10. In the event that a blowout occurred in borehole 12, a relief borehole 14 would typically be drilled directionally in an attempt to intersect borehole 12 at point 18. As illustrated, the lower end of borehole 14 has missed borehole 12 by a short distance and passed behind it.

Figure 2:
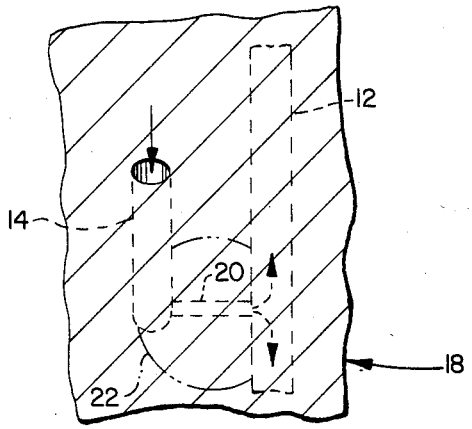
FIG. 2 a side view of the two boreholes of FIG. 1 at their point of closest proximity.

FIG. 2 is a side view as indicated by the arrows 2—2 in FIG. 1 of the region 18 at which wells 12 and 14 are in closest proximity. In the typical effort to kill the blowout in well 10, it is required that an appropriate fluid such as heavy drilling mud be pumped down the offset well 14 and into well 12 at the point 18. Since the boreholes do not actually intersect, a communication channel is often provided by fracturing the formation around borehole 14 in the hopes that the fracture will intersect borehole 12. For example such a communication link is indicated at 20. However, as noted above, in many cases the fracture will propagate in such a way as to never intersect borehole 12.

I have found that the fracturing pressures of subsurface formations can be reduced substantially by cooling those formations. As the formation is cooled, the internal stresses which must be overcome to form a fracture are reduced. Stress reductions of twenty pounds per square inch per degree Farenheit of temperature reduction are typically obtainable. The actual stress reduction in any given case may be substantially more or or less than the typical values due to wide variation in formation properties. This stress reduction effect is used to enhance the formation of fractures in the region 18 around wellbore 12 to thereby direct or guide the fractures in the proper direction.

The subsurface formations are generally permeable to some extent. In practicing the present invention, therefore, a cooling fluid is pumped down borehole 14 at a pressure below the formation fracturing pressure. The cooling fluid, therefore, flows out into the formations surrounding borehole 14 but does not cause the initiation of fractures. Pressure in borehole 14 is, however, maintained above the pressure of fluids in borehole 12 which, therefore, provides a low pressure zone to which the fluids tend to flow. As a result of the pressure differentials, the cooling fluid tends to flow preferentially from borehole 14 to borehole 12 generating a cooled zone as indicated by the dotted line 22 in those portions of the formation lying between boreholes 12 and 14. Once the zone 22 has been sufficiently cooled, pressure in borehole 14 is increased and if desired, a special fracturing fluid may be injected. It is anticipated that a temperature decrease of 5° to 10° or more can be achieved within zone 22. As a result, a fracturing pressure of the formation is zone 22 will be reduced by 100 to 200 pounds per square inch. By carefully controlling the pressure in borehole 14, it is possible to provide a fracturing pressure below that of the uncooled portions of the formation but above that of the zone 22. As a result, the initiation of fractures will be limited to zone 22. As the fractures propagate to the edges of zone 22, they will tend to be stopped since the required pressures in the uncooled portions of the formations will be above the available fracturing pressure. The use of the cooled zone, therefore, inhibits growth of fractures beyond the desired regions in addition to enhancing the fracture initiation at the desired locations. The combination of these effects will greatly increase the likelihood that a fracture will propagate from borehole 14 and intersect borehole 12 as desired.

It is not anticipated that any particular fluids are essential to the various steps of the process. Water would typically be used as the injected cooling fluid primarily because of its availability and low cost. Special hydraulic fracturing fluids may be used if desired during the fracturing step. The fracturing fluid should, for best performance, be chilled well below ambient formation temperature. Fluid used for plugging or killing of blowout well 12 would typically be a heavy drilling mud as conventionally used for such purposes.

The process of the present invention may also be used for generating link channels between wells in other processes. For example, in coal gasification processes, it is necessary to generate a link channel between adjacent injection and production wells before the main burn zone may be ignited. It is known that fractures may be used to form such link channels. By injecting a cold fluid, for example water, in the injection well below the fracturing pressure and producing it from the production well, a cooled zone may be provided between the two wells as illustrated in the FIGURES. When injection pressure is increased to fracturing levels, the cooled zone will tend to direct the fractures from the injection well to the production well for the same reasons described above. When the fracture has been extended from the injection to the production well and propped open to provide a low resistance flow path, the conventional gasification process can be initiated. In similar fashion, the process of the present invention may be applied to in-situ shale retorting and enhanced oil recovery fire flood processes.

While the present invention has been illustrated and described with respect to particular apparatus and methods of use, it is apparent that various modifications and changes can be made within the scope of the present invention as defined by the appended claims.

What is claimed is:

1. A method of lowering the fracturing pressure of an earth formation portion lying between two boreholes comprising:

before initiation of a fracture in the earth formation portion, pumping a cooling fluid down a first of said two boreholes at a pressure below formation fracturing pressure, through said earth formation portion and into a second of said two boreholes for a time sufficient to lower the temperature of said formation portion lying between said two boreholes.

* * * * *